US006410875B2

(12) United States Patent
Allard et al.

(10) Patent No.: US 6,410,875 B2
(45) Date of Patent: Jun. 25, 2002

(54) ELECTRICAL SWITCHGEAR APPARATUS COMPRISING A VACUUM CARTRIDGE AND A FLEXIBLE ELECTRICAL CONNECTOR

(75) Inventors: Hervé Allard, Crolles; Reynald Marin-Pache, Biviers; Thierry Milan, Grenoble, all of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/794,333

(22) Filed: Feb. 28, 2001

(30) Foreign Application Priority Data

Mar. 31, 2000 (FR) ..... 00 04154

(51) Int. Cl.[7] ..... H01H 33/66

(52) U.S. Cl. ..... 218/118; 218/120; 218/137; 218/140

(58) Field of Search ..... 218/155, 118–120, 218/121, 134–137, 139–140

(56) References Cited

U.S. PATENT DOCUMENTS

| | | | | |
|---|---|---|---|---|
| 3,663,906 A | | 5/1972 | Barkan et al. | |
| 4,077,114 A | | 3/1978 | Sakuma | |
| 5,486,662 A | * | 1/1996 | Takiishi | 218/120 |
| 5,530,216 A | * | 6/1996 | Benke et al. | 218/118 |
| 6,015,957 A | | 1/2000 | Papallo, Jr. et al. | |

FOREIGN PATENT DOCUMENTS

| | | |
|---|---|---|
| EP | 0 058 519 | 8/1982 |
| EP | 0 932 173 | 7/1999 |

* cited by examiner

*Primary Examiner*—Lincoln Donovan
*Assistant Examiner*—Tuyen T. Nguyen
(74) *Attorney, Agent, or Firm*—Parkhurst & Wendel, L.L.P.

(57) ABSTRACT

A switchgear apparatus comprises a vacuum cartridge one contact of which is fixedly secured to a metal rod protruding out from the cartridge. A flexible metallic electrical connector designed to electrically connect the rod to a busbar is provided, at one of its ends, with a bored hole in which one end of the rod is inserted. The joint between the flexible electrical connector and the rod is achieved by means of a braze implementing a metallic filler compound having a low melting temperature, so as not to damage the cartridge when the brazing operation is performed.

15 Claims, 5 Drawing Sheets

ELECTRICAL SWITCHGEAR APPARATUS COMPRISING A VACUUM CARTRIDGE AND A FLEXIBLE ELECTRICAL CONNECTOR

BACKGROUND OF THE INVENTION

The invention relates to an electrical switchgear apparatus comprising a movable rod and a flexible electrical connector between the movable rod and a fixed connecting strip.

The document EP 0,058,519 describes a switchgear apparatus whose movable contact means comprises a cylindrical rod movable in translation along its axis. This rod is connected to an external connecting strip by means of a flexible conductor formed by a stack of metal strips. Each metal strip has a circular opening provided with flanges protruding out from the plane of the metal strip, towards the center of the opening. To fit the flexible conductor onto the rod, the rod is inserted in the openings of the strip, and the conductors are then sandwiched between two clamping plates. The plates are bolted to one another. When the bolts are tightened, the plates tend to compress the metal strips of the flexible conductor in the area where the openings are located, causing deformation and buckling of the flanges in contact with the rod.

A connection of this kind requires a fairly lengthy assembly time. Moreover, it implements bulky mechanical parts which have to move with the rod when opening and closing of the switchgear apparatus take place. This results in the opening and closing energies being high and in the shocks caused at the end of travel also having a high energy. The whole of the switchgear apparatus opening and closing mechanism then has to be dimensioned so as to be able to supply such opening and closing energies, and to be able to withstand the corresponding shock energies. Furthermore, the temperature of the rod increases when a rated current is flowing through the cartridge, reaching temperatures of around 100° C. and more at the level of the flexible conductor fixing. At such temperatures, fixing by bolts does not seem to be a dependable solution in time.

It has been proposed, in U.S. Pat. No. 5,530,216, to fix a flexible electrical connector formed by a stack of metal strips directly to the rod of a vacuum cartridge, without having recourse to clamping plates. The stack comprises two rigid end regions and a flexible middle region. One of the end regions comprises an opening provided with flanges protruding out from the plane of the opening. Once the rod has been inserted in the opening, a press equipped with an annular tool presses the flanges so that the latter constitute a forcible adjustment on the rod. Once the tool has been removed, the rod and the flexible electrical connector are fixedly secured to one another. This fixing process imposes large mechanical stresses on the rod when assembly is performed. However, the movable assembly of a vacuum cartridge is fragile and must not be subjected to stresses outside of its translation axis. Precautions therefore have to be taken to avoid damaging the cartridge when fixing the connector. Furthermore, it should be emphasized that the forcible adjustment zone, which ensures the flow of current between the rod and the movable conductor, has a high resistivity and that it is subjected, when the rated current is flowing, to a temperature increase which tends to cause differential expansions of the different elements, due to the differences of expansion coefficients of the materials constituting the rod on the one hand and the stack of metal plates on the other hand. In addition to this expansion effect, the materials also tend to buckle under the influence of temperature, particularly in the forcible adjustment zone.

Moreover, any local deterioration of the joint which may start to appear tends to be accentuated in time, due to the fact that it increases the resistivity locally, causing a temperature increase. The reliability of the fixing is thereby decreased.

A movable contact part for a high-voltage self-extinguishing expansion circuit breaker is moreover described in the document EP 0,932,173. This part comprises a cylindrical conducting tube, one axial end of which bears a contact and the other axial end of which is brazed onto a second conducting element made of die-cast copper. This second conducting element is provided with a base part presenting notches enabling one end of a conducting braid to be welded, the other end of the braid being welded to an electrical connection stud. Such a construction is difficult to transpose to an electrical switchgear apparatus comprising a vacuum cartridge. It is in fact very delicate to weld a braid onto a metal element fixedly secured to the rod of the cartridge, since the thermal energy input is liable to damage the brazes of the cartridge. In addition, the movable contact part obtained is heavy due to the bulky second conducting element. Finally, assembly is relatively complex.

OBJECT OF THE INVENTION

The object of the invention is therefore to remedy the shortcomings of the state of the technique and to propose a junction zone between the movable rod of a switchgear apparatus and a flexible electrical connector, which presents excellent current conducting properties, is light, reliable in time, and simple to manufacture.

According to the invention, this problem is overcome by means of an electrical switchgear apparatus designed to be electrically connected to a busbar and comprising:

- a vacuum cartridge comprising a body forming an enclosure housing a pair of separable contacts, one of said contacts being fixedly secured to a metal rod movable in translation, a part of the rod protruding out from the enclosure of the cartridge;
- a flexible metallic electrical connector designed to electrically connect the rod to the busbar, the flexible connector being formed by a stack of metal blades and comprising a first rigid end part defining a bored hole in which the protruding part of the rod is inserted;

wherein:

- the metal blades are assembled to one another by welding at the level of said first rigid end part so as to form a monoblock assembly at this level,
- the flexible electrical connector is fixed to the protruding part of the rod by means of a braze between the protruding part of the rod and the first rigid end part.

The braze achieves a metallurgical connection between the rod and the flexible conductor. The metallic filler compound has a fixed melting point, dependent on the chemical elements which constitute said compound, which is lower than the melting points of the metal parts it enables to be bonded. The parts to be bonded, i.e. the rod and the flexible connector, must not in fact take part by melting in constituting the joint when assembly of the parts is performed. The flexible connector formed by a stack of metal blades assembled to one another by welding at the level of said first rigid end part so as to form a monoblock assembly at this level ensures the good mechanical strength of the assembly, while achieving a great flexibility at low cost.

This fixing mode had not been envisaged up to now, no doubt because it involves a heating stage in the process which was felt to constitute a drawback. The cartridge does in fact itself comprise brazes and materials sensitive to high temperatures. Damage to the cartridge due to the heating stage necessary for brazing the rod and the flexible connector therefore has to be avoided. That is why a metallic filler composition was chosen whose melting point is not very high, i.e., in the context of the present invention, lower than the temperature liable to damage the cartridge. In particular, if the cartridge comprises a sealing bellows brazed onto the rod, a braze having a lower melting temperature than that used to braze the sealing bellows onto the rod will be chosen for the braze fixing the flexible electrical connector to the rod.

To prevent any damage to the cartridge when brazing the electrical connector, the melting point of the braze has to be lower than 900° C., and preferably lower than 700° C. However, the choice of a braze with a low melting temperature must not be made to the detriment of the electrical conductivity of the braze joint, nor to the detriment of the mechanical strength of this joint. Preferably, the metallic filler compound is a silver-based compound in proportions of more than 30%, with a tin content in proportions of less than 10%. More particularly, proportions of silver greater than 50% with a tin content in proportions of less than 6% will be preferred. The silver gives the braze an excellent electrical conductivity. The tin for its part enables the brazing temperature to be lowered, but has the drawback of making the braze ductile (soft solder), which is undesirable. That is why the proportion of tin has to remain low. Advantageously, a quaternary Ag—Cu—Zn—Sn compound can be used. According to one embodiment, the compound is quaternary and contains 56% silver, 22% copper, 17% zinc and 5% tin, with a melting point of about 650° C. The braze does not contain any cadmium, in spite of the known property of this component to lower brazing temperatures, due to its potential harmfulness for the environment.

The metallurgical connection obtained provides an excellent electrical conduction. It does not increase the weight of the movable assembly, so that the kinetic energy to be dissipated at the end of opening or closing travel remains relatively low. Once brazing has been performed, the joint is not sensitive to the temperatures of around 100° C. to which it is subjected when the current is flowing, so that it does not deteriorate in time due to the influence of the temperature.

Advantageously, the protruding part of the rod comprises a spindle, limited on the cartridge side by a shoulder, a part of the filler compound forming an interface joint interposed axially between the shoulder and an axial edge of the bored hole, and another part of the filler compound forming a radial interface joint between the bored hole and the spindle. A joint having an excellent mechanical strength is thus obtained. The spindle constitutes a free end of the rod, so that the assembly operation is particularly simple. All that has to be done is to fit a brazing washer, followed by the bored hole of the connector, onto the spindle, before performing the brazing operation.

Advantageously, the spindle is of circular cross-section, as is the bored hole, so that the radial interface joint between the bored hole and the spindle takes a cylindrical shape, which enables radial positioning constraints of the connector with respect to the spindle to be overcome.

According to one embodiment, welding is performed by electron bombardment welding or by electron scattering welding, without any filler metal.

Advantageously, the flexible connector comprises a second rigid end part forming a connecting strip equipped with means for connection to the busbar, the flexible part being situated between the first and second rigid end parts. The flexible connector then performs the function of both flexible connection and that of connecting strip for a busbar. Bored holes, tapped or not, can be provided for fixing to the busbar.

In this case, it is particularly advantageous to provide for the flexible connector to be formed by a stack of metal blades, assembled to one another by welding at the level of said first and second rigid end parts, the metal blades remaining independent from one another in the flexible part of the connector.

BRIEF DESCRIPTION OF THE DRAWINGS

Other advantages and features will become more clearly apparent from the following description of a particular embodiment of the invention, given as a non-restrictive example only and represented in the accompanying drawings in which.

DETAILED DESCRIPTION OF THE PREFERRED EMBODIMENT

Figure 1:
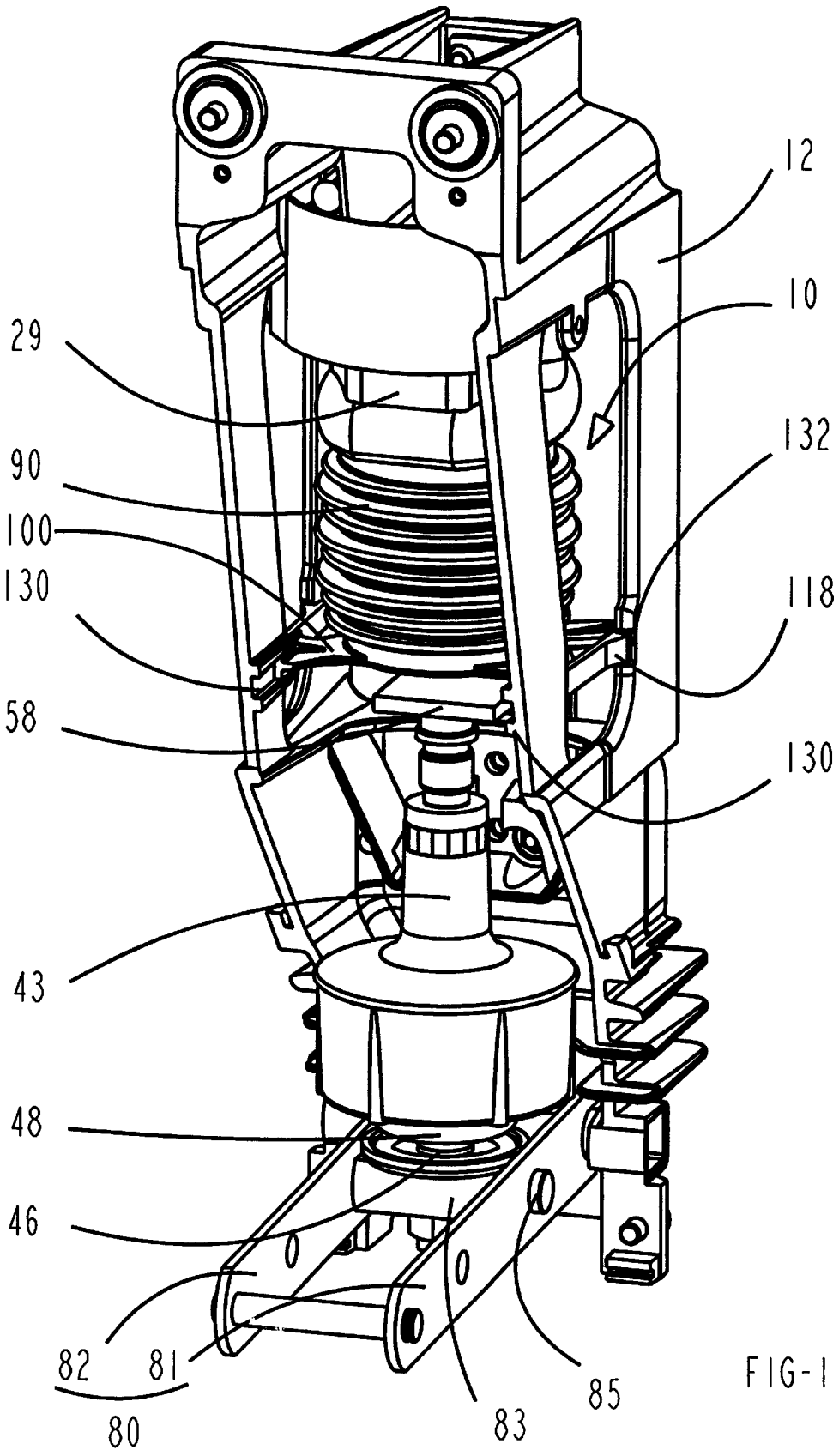
FIG. 1 represents a perspective view of an apparatus according to the invention, comprising a vacuum cartridge fitted in a support frame.
Figure 2:
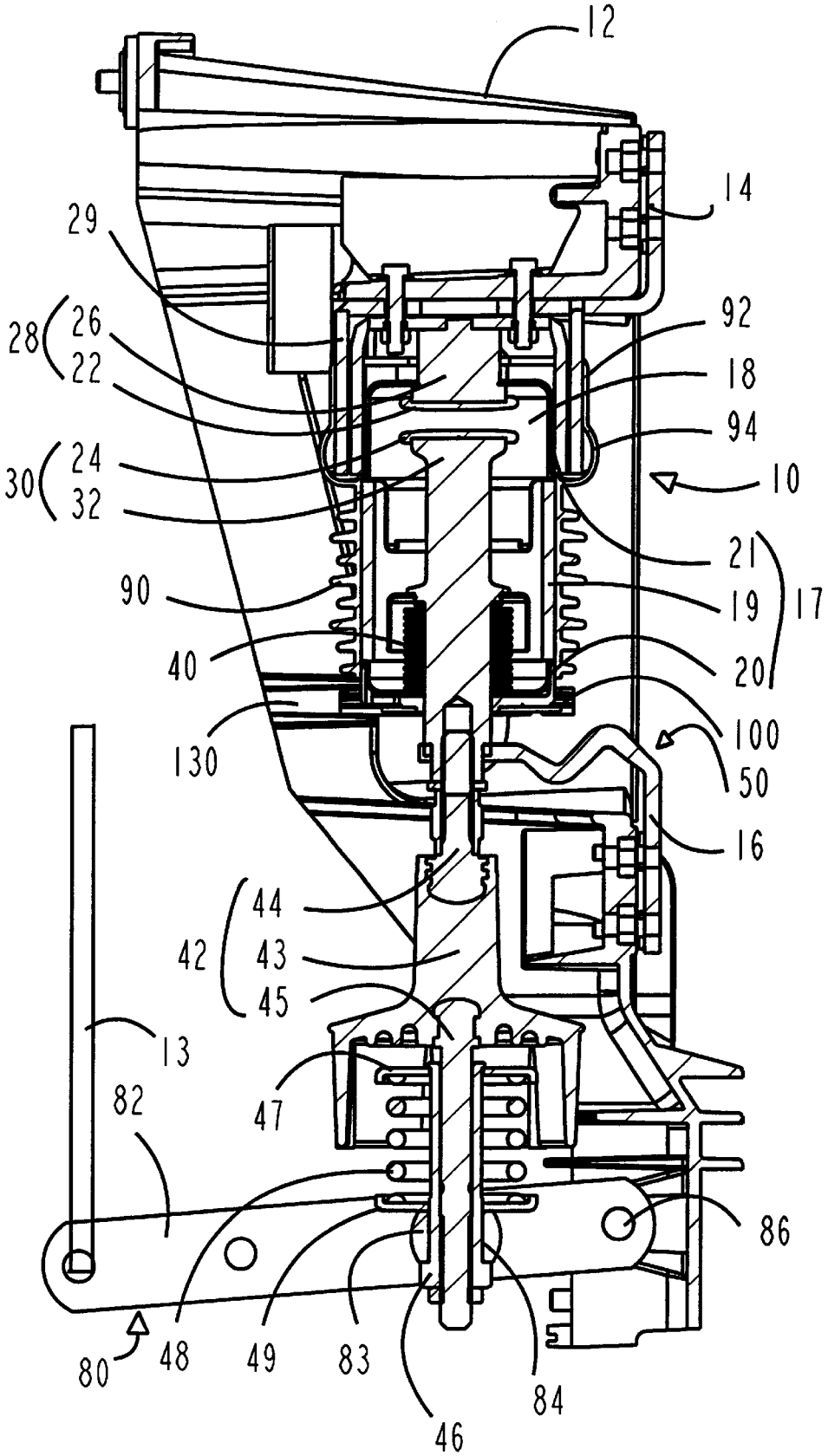
FIG. 2 represents an axial sectional view of the apparatus of FIG. 1.

With reference to FIGS. 1 and 2, a switchgear apparatus comprises a vacuum cartridge 10 supported by a frame 12 and driven by a mechanism 13 of conventional type. Two connecting strips 14 and 16, fixed to the frame 12, are designed to connect the apparatus electrically to a busbar (not represented).

The generic expression vacuum cartridge is used here to designate an assembly of known type, comprising a cylindrical body 17 forming an enclosure 18 wherein a relative vacuum prevails and housing a pair of separable contacts 22, 24. The body 17 is itself divided into a middle insulating section 19 made of insulating material, a first metal end section 20 forming a first closing flange, and a second metal end section 21 forming a second closing flange. One of the contacts is a pad 22 brazed onto the end of a conducting cylinder 26 and forms a stationary contact means 28 with this cylinder. The cylinder 26 passes through the second flange 21 and is welded to the latter. The cylinder 26 is also welded onto a rigid metal coil 29, itself welded to the connecting strip 14. An electrical connection is thus achieved between the stationary contact means 28 and the connecting strip 14, by means of the coil 29. The coil 29 is designed to induce a magnetic field, in the separation zone of the contacts 22, 24, favorable to breaking of an electric arc arising between the contacts when separation of the latter takes place. Screws perform fixing of the coil 29 to the frame 12, and therefore rigid fixing between the cylinder 26, itself fixedly secured to the body 17 of the cartridge, and the frame 12. Moreover, and as will be explained in detail further on, the first flange 20 is positioned and secured with respect to the frame 12 by means of a fixing collar 100 secured in a groove 130 of the frame.

The contact 24 is a pad brazed onto the end of a movable contact means 30 whose body is formed by a metal conducting rod 32, in this instance a copper rod, passing through an orifice of the first flange 20. This rod 32 is extended outside the enclosure, as can be seen more clearly in FIG. 5, by a part 36 of smaller diameter, thus defining an intermediate shoulder 38. The end of the rod is provided with an axial tapped hole 39. A sealing bellows 40 brazed onto the rod 32 and onto the internal wall of the first end section allows an axial translation movement of the movable contact means 30 with respect to the stationary contact means 28, while preserving the vacuum prevailing in the enclosure 18.

The rod 32 is connected to a lever 80 with two parallel arms 81, 82, by means of an insulating arm 42. The insulating arm 42 comprises a body made of plastic material 43 overmolding on the one hand the head of a first threaded rod 44, and on the other hand the head of a second threaded rod 45 situated in the axial extension of the first rod. The first threaded rod 44 is screwed into the tapped blind hole 39 situated at the end of the rod 32 of the cartridge. A tubular adjusting nut 46 is screwed onto the second threaded rod 45. At one end the nut supports a support seat 47 for the end of a contact pressure spring 48. The other end of the spring 48 bears on a second support seat 49, which rests on a bar 83. The bar 83 comprises a bored hole 84 forming a guide sheath through which sheath the tubular nut 46 passes. The bar 83 rotates freely in lateral spindles 85 supported by the arms 81, 82 of the lever 80. The guide sheath 84 allows both translation of the nut 46 parallel to its axis and free rotation thereof. The nut 46 comprises a shoulder resting on the bar part 83 opposite the second support seat 49. The two arms 81, 82 of the lever 80 pivot around a spindle 86 supported by the frame 12 and are actuated jointly at their free end by a closing and opening mechanism (not represented), this mechanism being designed to drive the movable contact means 30 between a position in contact with the stationary contact means 28 and a separated position. When opening takes place, the lever 80 pivots counter-clockwise around the spindle 86 in FIG. 2, driving the bar 83, the nut 46, the arm 42 and the movable contact means 30 directly. When closing takes place, the lever 80 pivots clockwise around the spindle 86, driving the bar 83 which compresses the spring 48 by means of the support seat 49. The closing force is then transmitted by the spring 48 to the movable contact 30 by means of a transmission system comprising the support seat 47, the nut 46 and the insulating arm 42.

Figure 3:
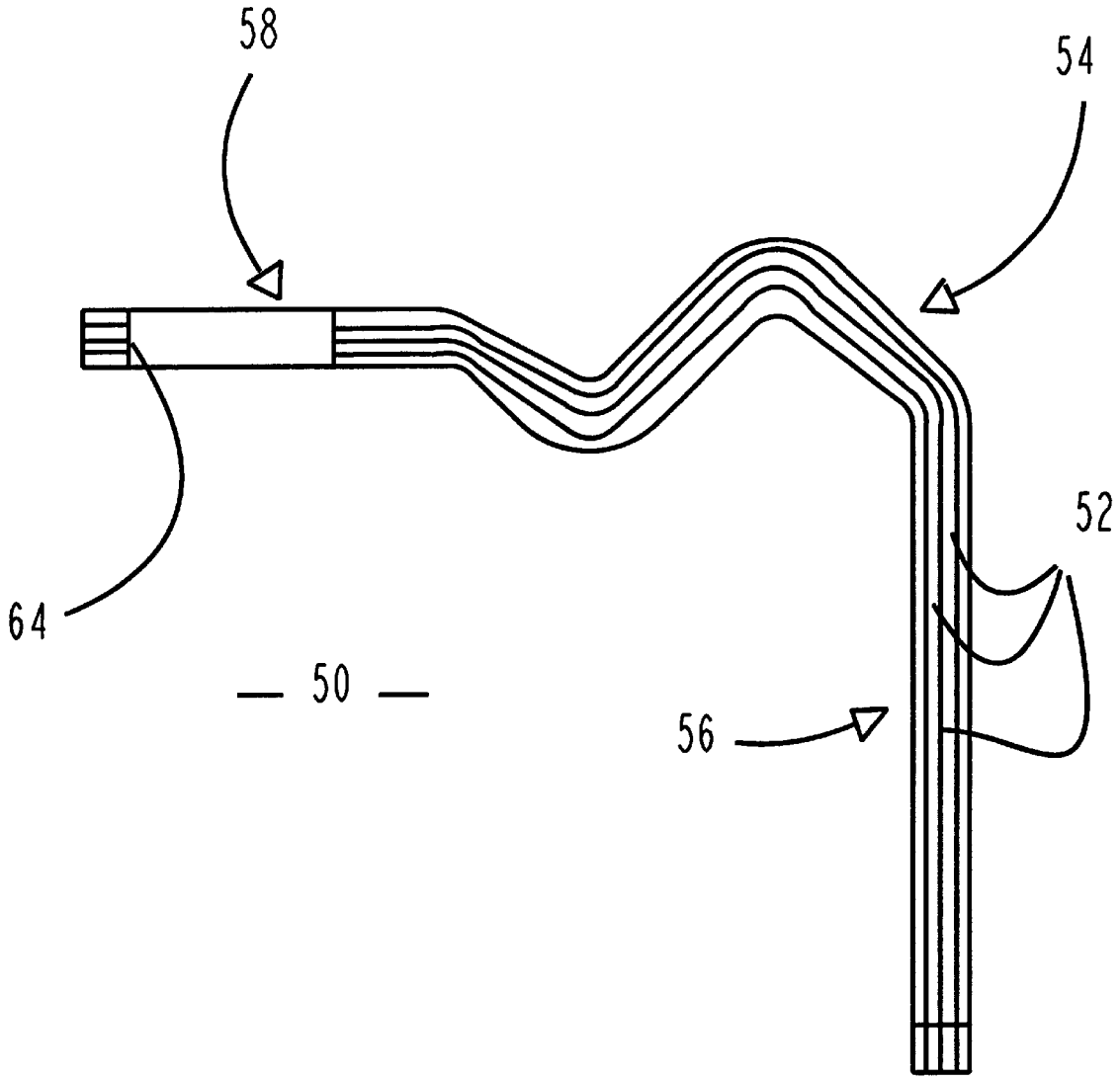
FIG. 3 represents a flexible electrical connector enabling an electrical connection to be achieved between the cartridge and a connecting strip.
Figure 4:
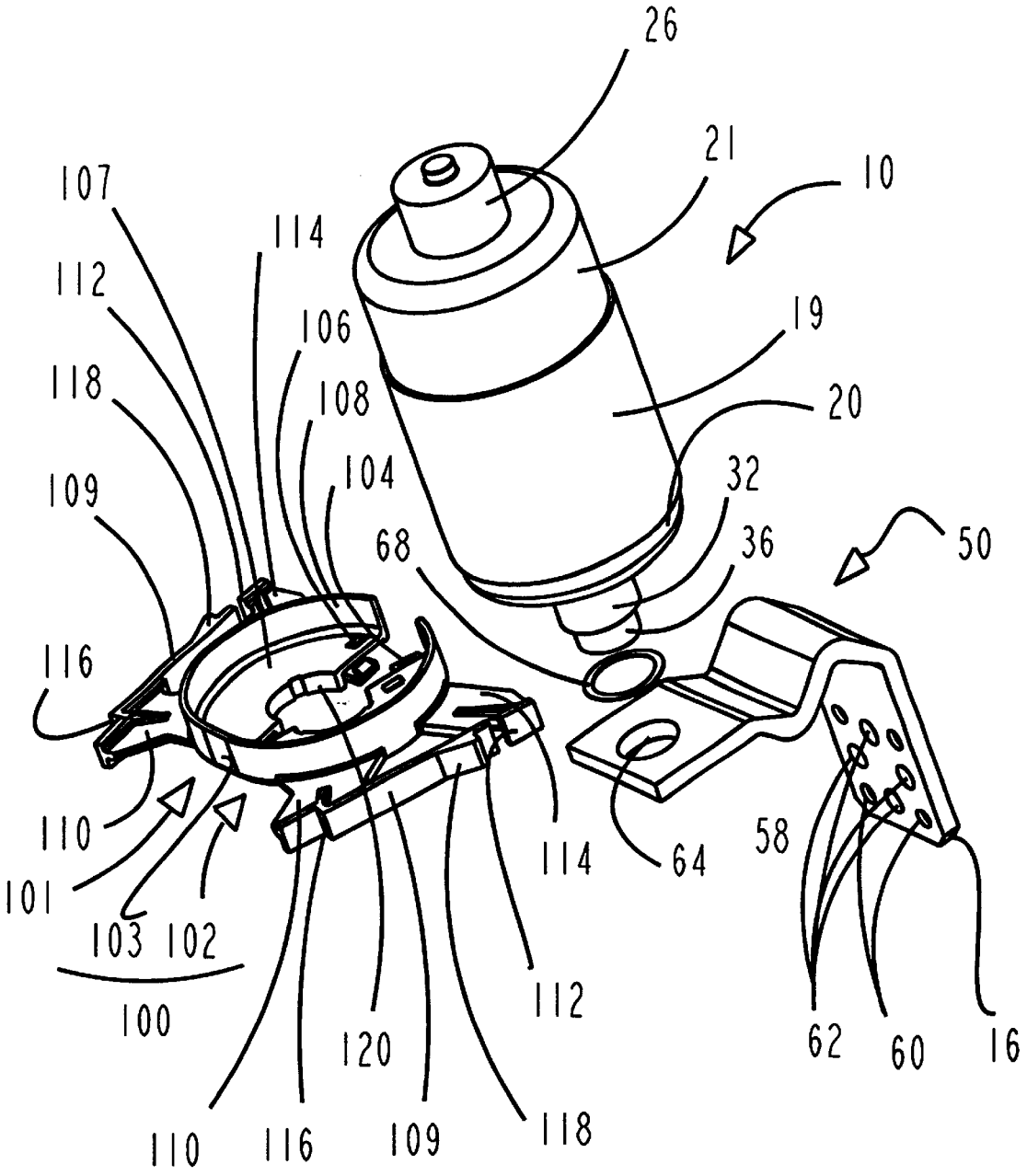
FIG. 4 represents an exploded view of a part of the apparatus before assembly thereof.

Electrical connection of the rod 32 to the busbar is performed by means of a flexible electrical connector 50, represented schematically in FIG. 3, one end 56 of which connector constitutes the connecting strip 16, whereas the other end 58 of the connector is brazed onto the body of the rod 32. The flexible connector 50 is formed by a stack of metal blades 52, these blades being made of copper. Each metal blade 52 comprises a curved middle part 54 extended at each end by one of the flat end parts 56, 58. The blades 52 have different lengths and shapes so as to form together a stack having the required curved shaped at the level of the middle part 54. At the level of the ends 56, 58, the blades 52 are welded to one another by an atomic scattering welding process, without any filler material, so that each end constitutes a rigid monoblock part. In their middle part 54, the blades 52 remain separated from one another, which gives the electrical connector 50 thus formed a good overall flexibility. As illustrated in FIG. 4, the end part 56 constituting the connecting strip comprises fixing means 60, in the form of open tapped holes, for fixing of the connecting strip to the frame of the switchgear apparatus, and connection means 62, in the form of other tapped holes, for connection to a busbar. The other end part 58 comprises a bored hole 64 corresponding to the diameter of the spindle of the rod 36.

The collar 100, which can be seen in detail in FIG. 4, is made of plastic material, in this instance a 6-6 polyamide, and comprises two parts 101, 102 articulated on one another by a hinge 103 so as to be able to take an open assembly position represented in FIG. 4, and a closed position represented in FIG. 2, in which elastic hooks 104 clip into corresponding apertures 106. The closed collar forms a flange having a flat bottom 107 and a cylindrical peripheral wall 108 enabling the end of the first flange 20 of the cartridge 10 to be engaged therein. The center part of the flat bottom comprises an aperture 120 for the rod 32 of the cartridge to pass through. This aperture, of general cylindrical shape, performs guiding of the rod 32. The collar 100 is provided with two main side rails 109, connected to the flat bottom 107 by two side flanges 110, and two auxiliary side rails 112 connected to the flat bottom 107 by two other side flanges 114. Each auxiliary rail 112 is located in the extension of one of the main rails 109. Each main rail 109 forms a staggered stop 116 in a front part and an elastic clip 118 in a rear part.

The insulating section 19 of the body 17 of the cartridge is covered by an insulating sleeve 90 (FIG. 2) equipped with fins designed to increase the creepage distance between the live metal parts of the apparatus. The sleeve 90 widens out in its upper part and forms a lip 92 which overlaps a part of the coil 29 so as to increase the distance between the live metal parts. An intermediate padding 94, whose internal surface is covered with semi-conducting paint, smoothes the field lines close to the edges of the coil 29.

The body made of plastic material 43 of the insulating arm 42 forms a cylindrical skirt which protects the spring 48 and the threaded rod 45 and which thus performs the electrical insulation between the rod 32 and the flexible connector 50 on the one hand, and the mechanism on the other hand.

Fitting of the cartridge 10 in the frame 12 is performed in the following manner. In a first step, the cylinder 26 is welded to the sub-assembly formed by the coil 29 and the connecting strip 14. The insulating sleeve 90 is then engaged forcibly onto the body 17 of the cartridge and onto the coil 29.

Figure 5:
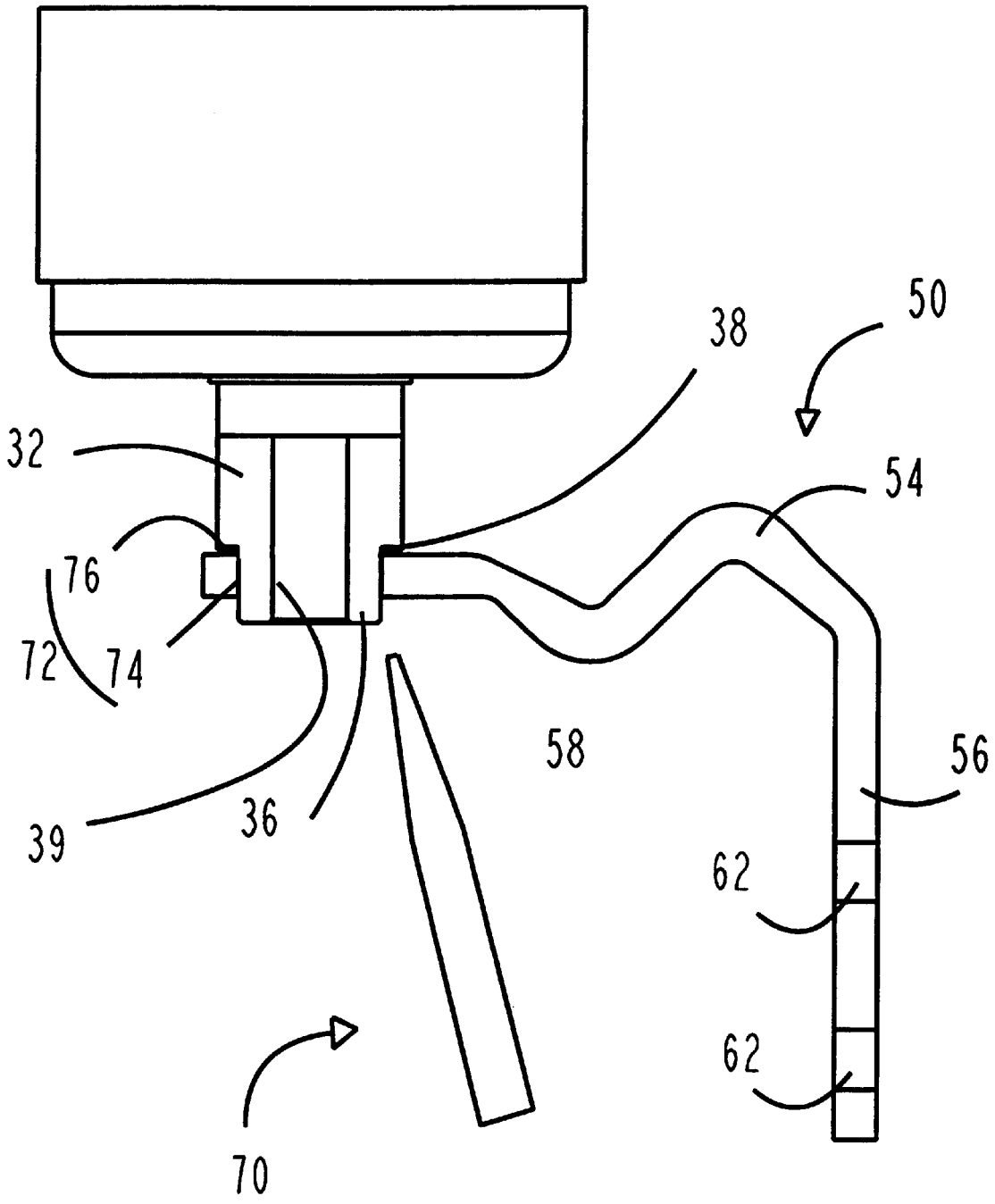
FIG. 5 schematically represents a brazing operation achieving a joint between a rod of the cartridge and the flexible electrical connector.

The cartridge 10 then has to be equipped with its electrical connector 50. The spindle 36 of the rod 32 is inserted in the bored hole 64, with an interposed washer made of metallic filler compound 68, according to the exploded drawing of FIG. 3. The metallic filler compound must have a relatively low melting temperature, preferably less than 700° C., so as not to damage the internal brazes of the cartridge. The compound involved in this instance is for example 56% silver, 22% copper, 17% zinc and 5% tin, having a melting point of about 650° C. A heat source 70, represented schematically in FIG. 5, is provided at the free end of the bored hole until melting of the washer 68 and axial infiltration by capillarity of a part of the metallic filler compound into the cylindrical space at the interface between the bored hole and the spindle is achieved. In a manner well known to a brazing specialist, the initial clearance between the parts, i.e. between the bored hole and the spindle, must be suitably chosen on the one hand to foster wetting of the surfaces to be assembled, when brazing takes place, and on the other hand to ensure the mechanical strength of the brazed joint under subsequent conditions of use. The brazed joint 72 obtained reveals on the one hand a cylindrical interface zone 74 between the bored hole and the spindle, and on the other hand an annular interface zone 76 between the top edge of the bored hole 64 and the shoulder 38 of the rod.

When this assembly has been completed, the rod 32 is inserted radially into the open collar 100, and the collar 100 is then closed so as to encircle the end of the first flange 20 of the body 17 of the cartridge and the rod 32, the elastic hooks 104 clipping into corresponding apertures 106. The assembly thus formed is then inserted laterally into the frame 12, the rails 109 being inserted in the lateral grooves 130 and forming a sliding guide with these grooves. The collar then forms a slide rack which slides in the grooves 130 until the stops 116 encounter corresponding surfaces of the frame, the clips 118 then closing on corresponding bearing surfaces 132 of the frame.

It then simply remains to secure the connecting strips 14, 16 and the coil 29 to the frame 12, to screw the insulating arm into the tapped hole of the rod and to adjust the contact pressure by means of the adjusting nut.

Strictly speaking, the movement transmitted to the rod 32 of the cartridge 10 by the lever 80 in the absence of clearance between the moving parts would not be perfectly straight with respect to the frame 12. However, the angle between the lever 80 and the rod 32 is always very close to a right angle, and the travel of the rod 32 of the cartridge between its open position and its closed position does not exceed a few millimeters, which corresponds to an angle of rotation of the lever 80 not exceeding a few degrees, so that in the absence of clearance, the radial movement of the rod 32 would be about one hundredth of its axial travel. In the embodiment described, this movement is taken up by the clearances existing between the various elements of the transmission system, in particular at the level of the gudgeons 85 and the spindle 86. However, if a greater travel was required, the bar 126 would be able to be guided in an oblong aperture of the lever 90, 92, 94.

The sub-assembly thus constituted forms a module which can be assembled and tested in the plant before being stored independently from the mechanism 13. Final assembly of the switchgear apparatus can be deferred. The modules enable switchgear apparatuses to be constituted differing from one another by the number of poles arranged side by side.

Various variations are naturally possible.

The cross-section of the rod and the corresponding cross-section of the bored hole are not necessarily circular. The stack of blades can be achieved with spacing washers fitted on the side where either of the ends are located, as described in the document U.S. Pat No. 5,530,216. The cartridge can have two movable contact means, rather than one movable contact means and one stationary contact means. The internal structure of the cartridge can be different from the one described. Guiding of the rod with respect to the cartridge can be performed by any suitable means. The switchgear apparatus can be of any type implementing vacuum cartridges, in particular a switch, or circuit with or without disconnection features.

What is claimed is:

1. An electrical switchgear apparatus electrically connected to a busbar and comprising:

a vacuum cartridge including a body forming an enclosure;

a pair of separable contacts housed in said enclosure, including a movable contact fixed to a metal rod, the rod having an end protruding through a wall of the cartridge, the rod being movable in translation with respect to the cartridge, and a flexible metallic electrical connector electrically connecting the rod to the busbar, the flexible connector having a first rigid end part defining a hole in which the protruding part of the rod is inserted, the flexible connector being a stack of metal blades assembled to one another by welding at said first rigid end part so as to form a monoblock assembly, the flexible electrical connector being fixed to the protruding part of the rod by a braze between the protruding part of the rod and the first rigid end part.

2. The switchgear apparatus according to claim 1, comprising a sealing bellows brazed to a wall of the body of the cartridge and to the rod, said braze between the protruding part of the rod and the first rigid end part including a metallic filler compound having a melting temperature lower than the melting temperature of the braze fixing the rod to the sealing bellows.

3. The switchgear apparatus according to claim 2, wherein the metallic filler compound has a melting temperature lower than 900° C.

4. The switchgear apparatus according to claim 3, wherein the metallic filler compound is a silver-based compound in proportions of more than 30%, with a tin content in proportions of less than 10%.

5. The switchgear apparatus according to claim 4, wherein the metallic filler compound is a silver-based compound in proportions of more than 50%, with a tin content in proportions of less than 6%.

6. The switchgear apparatus according to claim 5, wherein the metallic filler compound is a quaternary silver-copper-zinc-tin compound.

7. The switchgear apparatus claim 2, wherein the protruding part of the rod comprises a spindle, limited on the cartridge side by a shoulder, a part of the metallic filler compound forming an interface joint interposed axially between the shoulder and an axial edge of the bored hole, and another part of the metallic filler compound forming a radial interface joint between the bored hole and the spindle.

8. The switchgear apparatus according to claim 7, wherein the spindle and the bored hole each have a circular cross-section, so that the radial interface joint between the bored hole and the spindle has a cylindrical shape.

9. The switchgear apparatus according to claim 1, wherein the metal blades are assembled to one another by a welding method selected from a group of methods including electron bombardment welding and electron scattering welding, without filler material.

10. The switchgear apparatus according to claim 1, wherein the flexible connector comprises a second rigid end part forming a connecting strip having means for connection to the busbar, the first and second rigid end parts being joined by a flexible part of the flexible connector.

11. The switchgear apparatus according to claim 10, wherein the metal blades are assembled to one another by welding at said second rigid end part and remain independent from one another in the flexible part of the connector.

12. The switchgear apparatus according to claim 2, wherein the metallic filler compound has a melting temperature lower than 700° C.

13. The switchgear apparatus according to claim 12, wherein the metallic filler compound is a silver-based compound in proportions of more than 30%, with a tin content in proportions of less than 10%.

14. The switchgear apparatus according to claim 13, wherein the metallic filler compound is a silver-based compound in proportions of more than 50%, with a tin content in proportions of less than 6%.

15. The switchgear apparatus according to claim 14, wherein the metallic filler compound is a quaternary silver-copper-zinc-tin compound.

* * * * *